US006918166B2

(12) United States Patent
Evans

(10) Patent No.: US 6,918,166 B2
(45) Date of Patent: Jul. 19, 2005

(54) APPARATUS AND METHOD FOR INSTALLING SLATS

(76) Inventor: Terry Duane Evans, P.O. Box 26, Advance, MO (US) 63730

( * ) Notice: Subject to any disclaimer, the term of this patent is extended or adjusted under 35 U.S.C. 154(b) by 155 days.

(21) Appl. No.: 10/065,514

(22) Filed: Oct. 25, 2002

(65) Prior Publication Data

US 2003/0101574 A1 Jun. 5, 2003

Related U.S. Application Data

(60) Provisional application No. 60/333,886, filed on Nov. 30, 2001.

(51) Int. Cl.[7] ..... B25B 27/14
(52) U.S. Cl. ..... 29/278; 29/700
(58) Field of Search ..... 29/700, 721, 238, 29/24.5, 281.1, 270, 278; 81/484; 40/618, 611.01

(56) References Cited

U.S. PATENT DOCUMENTS 5,695,346 A 12/1997 Sekiguchi et al.
5,800,144 A 9/1998 Glenn et al.
6,426,826 B1 7/2002 Marco
6,482,288 B1 11/2002 Kreckel et al.
6,491,781 B1 12/2002 Kreckel et al.

FOREIGN PATENT DOCUMENTS

JP 10218552 * 8/1998

* cited by examiner

*Primary Examiner*—John C. Hong
(74) *Attorney, Agent, or Firm*—Armstrong Teasdale LLP

(57) ABSTRACT

Apparatus includes an upper plate assembly including a main portion, a first extension member and a second extension member. The extension members extending from the main portion at an angle. The apparatus also includes a lower plate assembly connected to the upper plate assembly, a first side plate, and a second side plate. The side plates connected to the lower plate assembly. Each side plate including a top and a bottom. The apparatus further includes an engaging assembly attached to the upper plate assembly and the lower plate assembly. Engagement of the engaging assembly causes the bottom of the first side plate to move toward the bottom of the second side plate.

13 Claims, 7 Drawing Sheets

APPARATUS AND METHOD FOR INSTALLING SLATS

CROSS REFERENCE TO RELATED APPLICATIONS

This application claims the benefit of U.S. Provisional Application No. 60/333,886 filed Nov. 30, 2001, which is hereby incorporated by reference in its entirety.

BACKGROUND OF INVENTION

This invention relates generally to signs and more particularly to apparatus and method for installing slats on signs.

Certain types of signs utilize replaceable slats that inter-fit within a pair of grooves on a front surface of the sign. The slats are typically manufactured from vinyl, plastic or aluminum. The slats are fit within the grooves and remain there until it is time to change the content of the sign. Once it is time to change the sign, the slats are removed and new slats are installed. A particular type of sign is a tri-vision sign. These signs have a plurality of adjacent slat holders. Each slat holder is triangular in shape and accommodates three slats. Once the slats are installed, the sign displays a first set of slats, then the slat holders rotate and displays a second set of slats, and the slat holders rotate again and the sign displays a third set of slats. Thus, three signs are held and displayed by such a device. One of the difficulties associated with such a sign is changing the slats.

SUMMARY OF INVENTION

In one aspect, an apparatus includes an upper plate assembly comprising a main portion, a first extension member and a second extension member. The extension members extend from the main portion at an angle. The apparatus also includes a lower plate assembly connected to the upper plate assembly and a first side plate and a second side plate. The side plates are connected to the lower plate assembly and each side plate includes a top and a bottom. The apparatus further includes an engaging assembly attached to the upper plate assembly and the lower plate assembly. Engagement of the engaging assembly causes the bottom of the first side plate to move toward the bottom of the second side plate.

In another aspect, a tool is provided for installing slats on a triangular slat holder. The tool comprising an upper plate assembly, a lower plate assembly connected to the upper plate assembly, a pair of side plates connected to the lower plate assembly, and an engaging assembly attached to the upper plate assembly and the lower plate assembly. Engagement of the engaging assembly causes a bottom of the first side plate to move toward a bottom of the second side plate.

In another aspect, a method is provided for installing slats on a triangular slat holder with a tool. The tool including an upper plate assembly, a lower plate assembly connected to the upper plate assembly, a pair of side plates connected to the lower plate assembly, and an engaging assembly attached to the upper plate assembly and the lower plate assembly. The method comprising inserting a slat adjacent the lower plate assembly, positioning the tool such that each side plate of the tool is adjacent a side of the slat holder and the slat is adjacent a side of the slat holder, affixing an end of the slat to an end of the slat holder, and moving the tool along a length of the slat holder to affix a length of the slat to a length of the slat holder.

DETAILED DESCRIPTION

Exemplary embodiments of apparatus and methods for installing slats are described below. In one embodiment, the apparatus is a tool configured to install slats on a triangular slat holder utilized in signs. The slats fit within a pair of grooves that extend along an outer portion of the slat holder. The tool locates the slat in the respective slat holder by applying pressure in the appropriate locations on the slat holder and the slat.

The apparatus and methods are not limited to the specific embodiments described herein. In addition, apparatus components can be practiced independent and separate from other components described herein.

Figure 1:
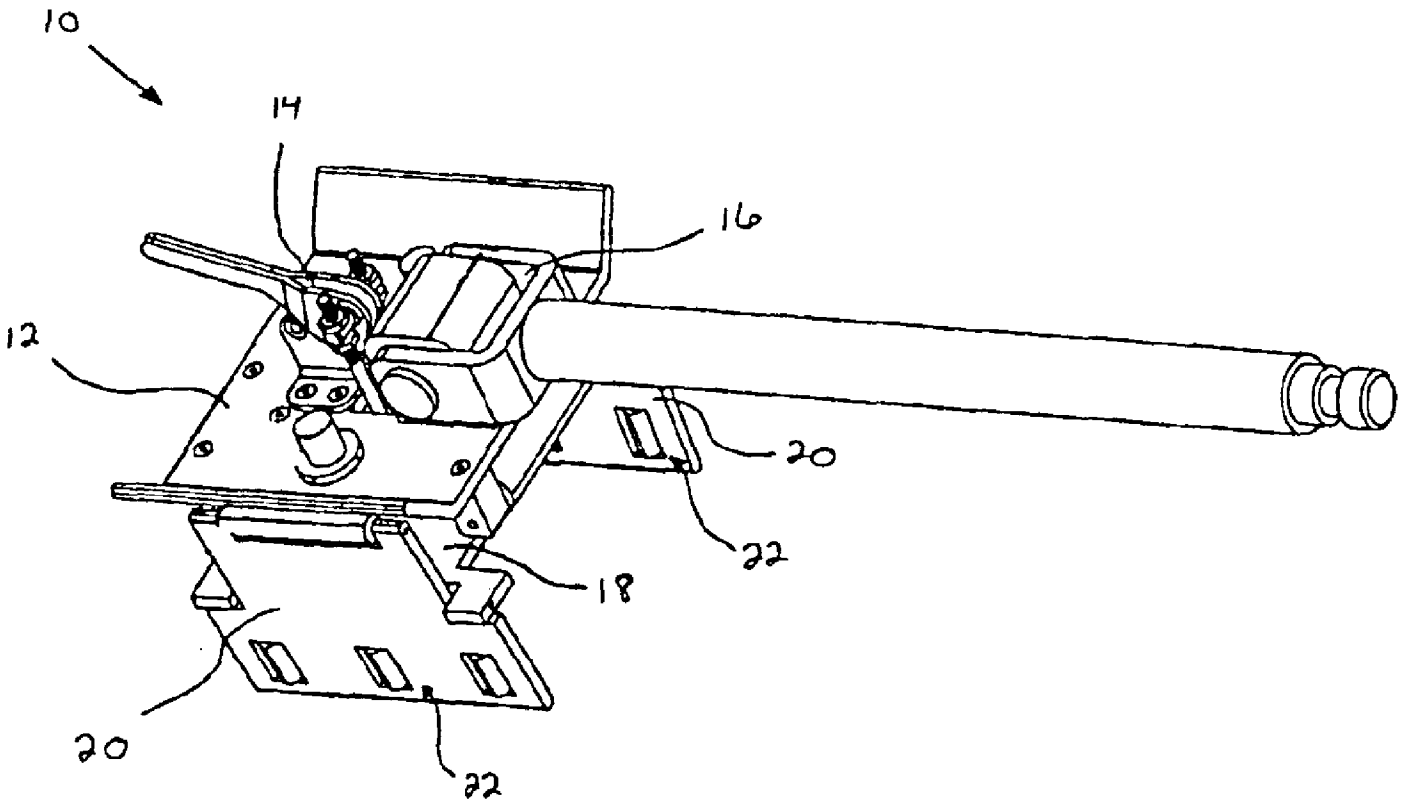
FIG. 1 is a perspective view of a slat installation tool in accordance with one embodiment of the invention.

In one embodiment and referring to FIG. 1, a slat installation tool 10 includes an upper plate assembly 12, an engaging assembly 14, a handle assembly 16, a lower plate assembly 18, and a pair of side plate assemblies 20. Each side plate assembly 20 includes at least one lower roller assembly 22.

Tool 10 is configured such that when engaging assembly 14 is engaged, lower plate assembly 18 moves towards upper plate assembly 12. In addition, side plates 20 travel along an angled portion of upper plate assembly 12 such that lower roller assembly 22 of one of side plates 20 moves towards lower roller assembly 22 of the other side plate 20.

Figure 2:
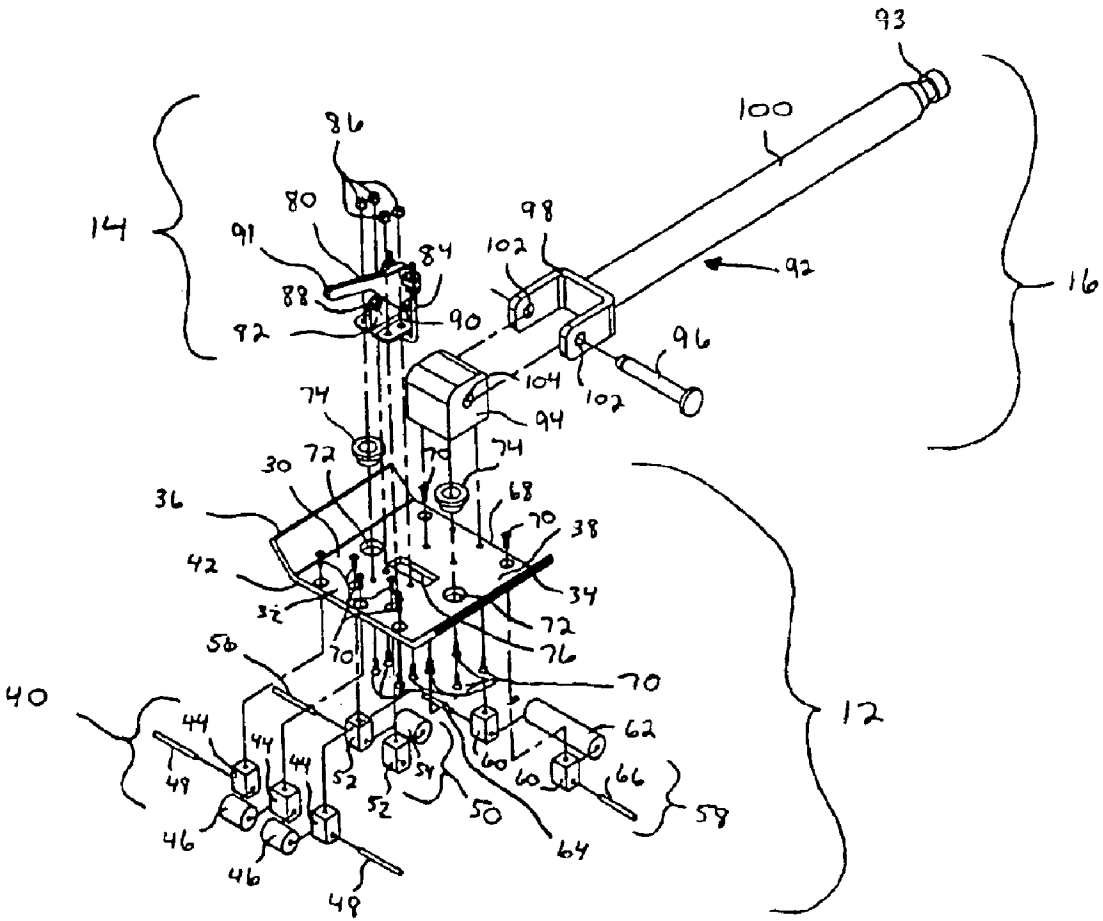
FIG. 2 is an exploded view of an upper plate assembly, an engaging assembly, and a handle assembly for the slat installation tool shown in FIG. 1.

FIG. 2 is an exploded view of upper plate assembly 12, engaging assembly 14, and handle assembly 16. Upper plate assembly 12 includes an upper plate 30 including a main portion 32, a first extension member 34 and a second extension member 36. Extension members 34 and 36 extend about 0.5 inches from main portion 32 at an angle. In one embodiment, the angle is between about 30 and 35 degrees. More particularly, extension members 34 and 36 extend from main portion 32 at an angle of about 33 degrees.

Upper plate 30 includes a top 38 and a bottom (not shown). A first roller assembly 40 is connected to the bottom of a front portion 42 of upper plate 30. First roller assembly 40 includes a plurality of roller mounting brackets 44 and a pair of rollers 46. Rollers 46 are mounted to roller mounting brackets 44 with a pair of roll pin axles 48. Each roll pin axle 48 extends through an outer roller mounting bracket 44, a roller 46 and partially through middle roller mounting bracket 44. Alternatively, a single axle pin extends through mounting brackets 44 and rollers 46. Upper plate assembly 12 also includes a second roller assembly 50 including a pair of mounting brackets 52 and a roller 54. Roller 54 is connected to mounting brackets 52 with a roll pin axle 56 that extends through mounting brackets 52 and roller 54. Second roller assembly 50 is mounted on the bottom of upper plate 30 adjacent first roller assembly 40. In one embodiment, a single roller (not shown), a pair of mounting brackets and a single axle pin (not shown) are utilized in place of first roller assembly 40 and second roller assembly 50.

Upper plate assembly 12 also includes a third roller assembly 58 including a pair of mounting brackets 60 and a roller 62. Roller 62 is connected to a first mounting bracket 60 with a first roll pin axle 64 and roller 62 is connected to a second mounting bracket 60 with a second roll pin axle 66. Roll pin axles 64 and 66 extend through mounting brackets 60 and roller 62, respectively. Third roller assembly 58 is mounted to the bottom of a back portion 68 of upper plate 30.

Roller assemblies 40, 50, and 58 are attached to the bottom of upper plate 30 with a plurality of fasteners 70. In the embodiment shown in FIG. 2, a screw extends at least partially through each mounting bracket 44, 52, and 60 and through upper plate 30. Rollers 46, 54, and 62 extend beyond mounting brackets 44, 52, and 60 respectively.

Upper plate 30 also includes a pair of guide pin receptacle openings 72 that extend through upper plate 30. A guide pin bushing 74 is positioned within each opening 72. Upper plate 30 further includes an engagement opening 76.

FIG. 2 also illustrates engaging assembly 14 including a lever 80, a mounting bracket 82, a connecting member 84, a plurality of fasteners 70, and a corresponding plurality of fastener connectors 86. In the embodiment shown in FIG. 2, fasteners 70 are bolts and fastener connectors 86 are nuts. Fasteners 70 extend through upper plate 30 and through mounting bracket 82 to attach mounting bracket 82 to top 38 of upper plate 30. Mounting bracket 82 includes a projecting member 88 that extends away from upper plate 30. Lever 80 extends around both sides of mounting bracket projecting member 88 and is pivotably connected to mounting bracket projecting member 88 with a connector pin 90. Pin 90 extends through projecting member 88 and through lever 80. Lever 80 is also fixedly connected to connecting member 84 such that a pivot action occurs when a front end 91 of lever 80 is moved, as discussed in more detail below.

Handle assembly 16 includes a handle 92, a mounting bracket 94, a mounting pin 96, and a plurality of fasteners 70. Mounting bracket 94 is mounted to top 38 of upper plate 30 utilizing fasteners 70. Handle 92 includes a mounting portion 98 and an extension member 100 extending from mounting portion 98. Mounting portion 98 is U-shaped and is sized to fit around mounting bracket 94. Mounting portion 98 includes a pair of openings 102 and mounting bracket 94 also includes an opening 104. Openings 102 and 104 are sized to receive mounting pin 96. Mounting pin 96 attaches handle 92 to mounting bracket 94 such that handle 92 pivots with respect to both mounting bracket 94 and upper plate 30. Handle 92 includes a handle attachment 93 for attachment to an extension handle.

Figure 3:
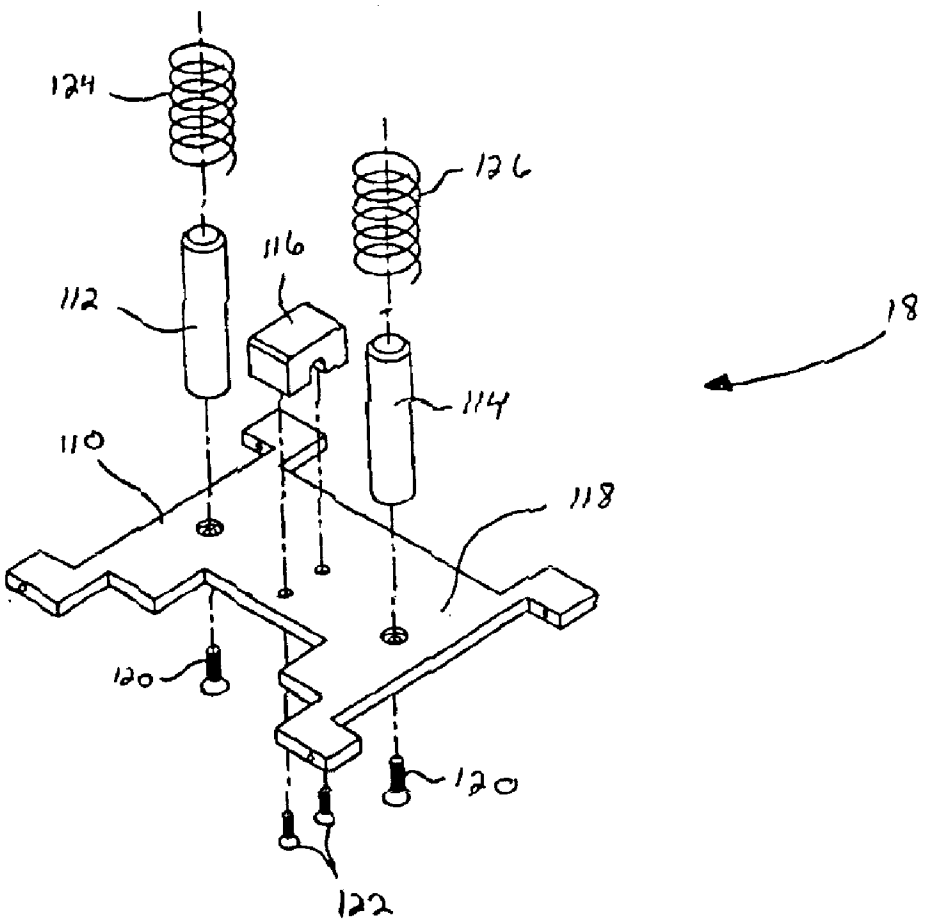
FIG. 3 is an exploded view of a lower plate assembly for the slat installation tool shown in FIG. 1.

FIG. 3 is an exploded view of lower plate assembly 18 including a lower plate 110, a first guide pin 112, a second guide pin 114, and a mounting bracket 116. Each guide pin 112 and 114 is connected to a top 118 of lower plate 110 with a fastener 120. Fasteners 120 extend through lower plate 110 and at least partially through a respective guide pin. Mounting bracket 116 is connected to top 118 of lower plate 110 with a pair of fasteners 122 that extend through lower plate 110 and at least partially through mounting bracket 116. In the embodiment shown in FIG. 3, fasteners 120 and 122 are screws. A first biasing member 124 extends around first guide pin 112 and a second biasing member 126 extends around second guide pin 114. In the embodiment shown in FIG. 3, biasing members 124 and 126 are coil springs extending around an outer perimeter of guide pins 112 and 114, respectively.

Figure 4:
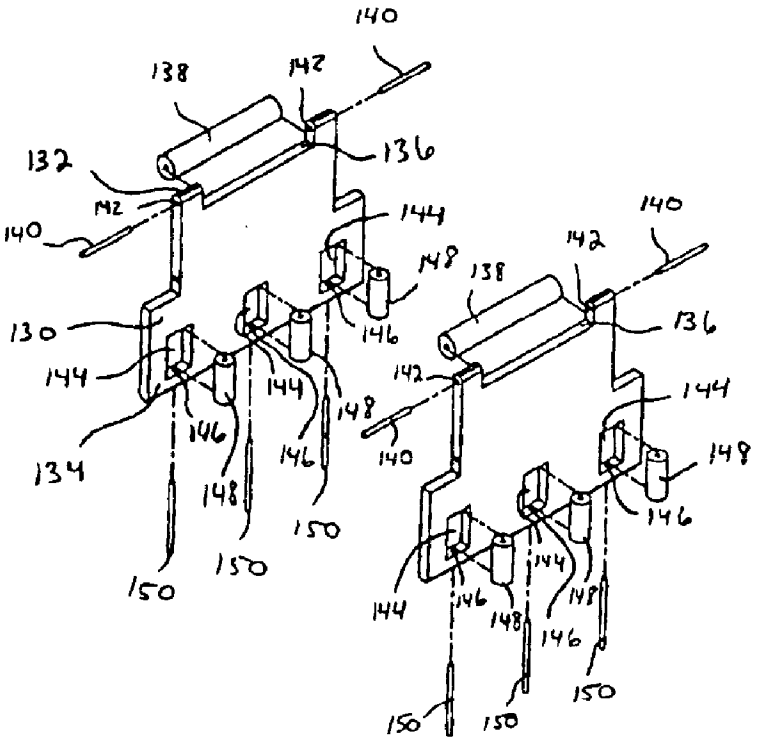
FIG. 4 is an exploded view of a pair of side plate assemblies for the slat installation tool shown in FIG. 1.

FIG. 4 is an exploded view of a pair of side plate assemblies 20. Each assembly 20 includes a side plate 130 having a top 132, a bottom 134, and a recess 136 at top 132. A roller 138 fits within recess 136 and connects to side plate 130 with a pair of roll pin axles 140 that extend through a respective opening 142 in side plate 130 and at least partially through roller 138. Side plate 130 also includes a plurality of lower roller openings 144 and respective pin axle openings 146. A lower roller 148 fits within each lower roller opening 144 and is attached to side plate 130 with a respective roller pin axle 150. Rollers 138 and 146 are sized to extend beyond an outer surface of side plate 130.

Figure 5:
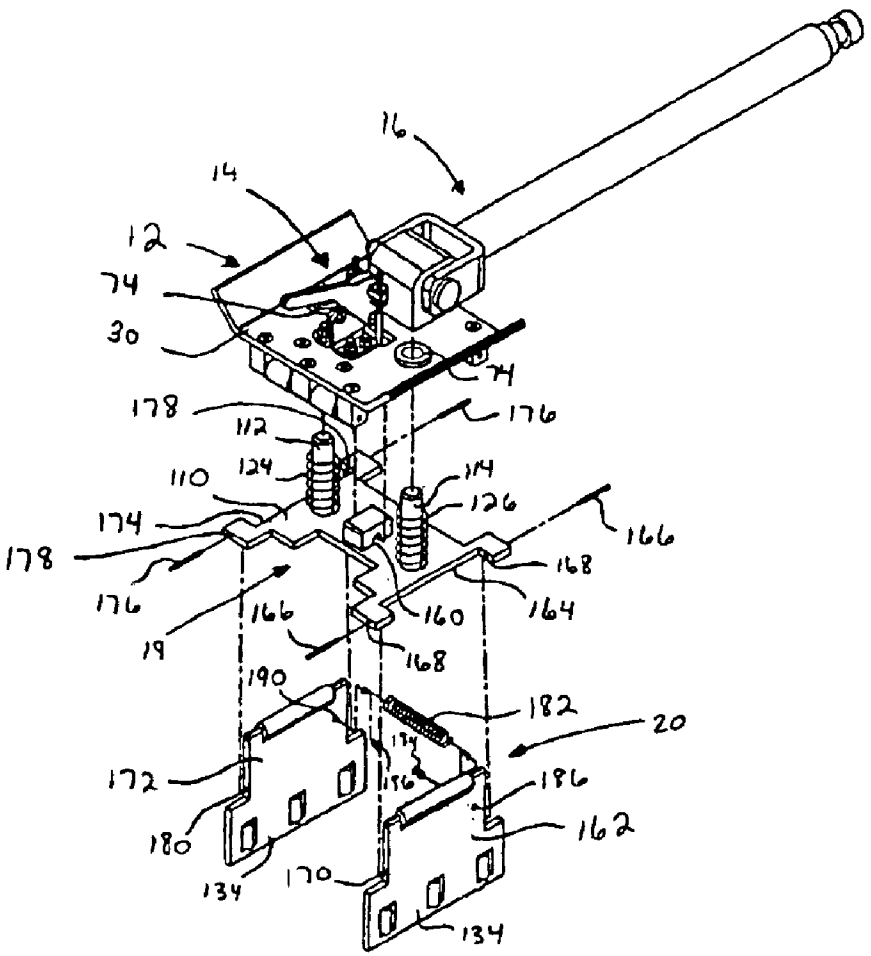
FIG. 5 is a partially exploded view of the combination of the upper plate assembly, engaging assembly, and handle assembly shown in FIG. 2, the lower plate assembly shown in FIG. 3, and the side plate assemblies shown in FIG. 4.

FIG. 5 is a partially exploded view of upper plate assembly 12, engaging assembly 14, handle assembly 16, lower plate assembly 18, and side plate assemblies 20. Guide pins 112 and 114 extend through guide pin bushings 74 connected to upper plate 30. Biasing members 124 and 126 contact upper plate 30 and lower plate 110 and help to maintain lower plate 110 distanced from upper plate 30 such that upper plate 30 does not contact mounting bracket 116 and lower plate 110 does not contact mounting brackets 44, 52, and 60. Connecting member 84 extends through engagement opening 76 and within a groove 160 formed in mounting bracket 116. Connecting member is maintained within groove 160 and between mounting bracket 160 and top 118 of lower plate 110. Movement of lever 80 moves connecting member 84 which causes lower plate 110 to move with respect to upper plate 30.

A first side plate 162 is connected to lower plate 110 at a first recess 164 with a pair of axle pins 166. Axle pins 166 extend through a respective pair of axle pin openings 168 within lower plate 110 and at least partially through a respective pair of openings 170 (only one opening is shown in FIG. 5) within first side plate 162. Similarly, a second side plate 172 is connected to lower plate 110 at a second recess 174 with a pair of axle pins 176. Axle pins 176 extend through a respective pair of axle pin openings 178 within lower plate 110 and at least partially through a respective pair of openings 180 (only one opening is shown in FIG. 5) within second side plate 172.

A biasing member 182 extends between first side plate 162 and second side plate 172. Biasing member 182 is attached to first side plate 162 with a fastener 184 that extends through a portion of biasing member 182 and through an opening 186 within first side plate 162. Biasing member 182 is attached to second side plate 172 with a fastener 188 that extends through a portion of biasing member 182 and through an opening 190 within second side plate 172. Biasing member 182 biases bottom 134 of first side plate 162 away from bottom 134 of second side plate 172. In the embodiment shown in FIG. 5, biasing member 182 is a coil spring.

Figure 6:
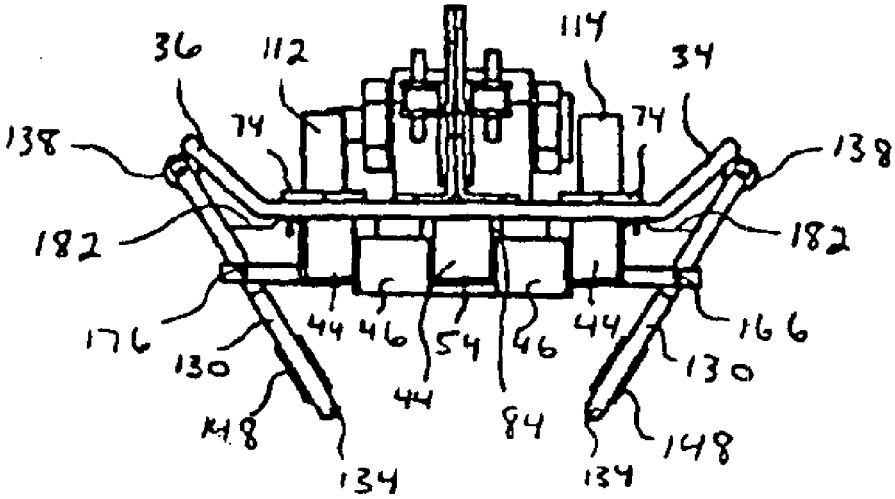
FIG. 6 is a front view of the slat installation tool shown in FIG. 1.

FIG. 6 is a front view of slat installation tool 10. FIG. 6 illustrates the inter-relationship between side plate assemblies 20 and upper plate assembly 12. As shown in FIG. 6, lower plate 110 is moved toward upper plate 30 when front end 91 of lever 80 is moved toward upper plate 30. Such movement of lever 80 causes a lower portion of connecting member 84 to move toward upper plate 30 which causes lower plate 110 to move toward upper plate 30. After lower plate 110 is moved toward upper plate 30, rollers 46, 54, and 62 extend beyond lower plate 110. In addition, movement of lower plate 110 towards upper plate 30 causes rollers 138 to travel along extension members 34 and 36. As rollers 138 travel along extension members 34 and 36, lower rollers 148 move toward each other as side plates 130 pivot about connecting pins 166 and 176. Although biasing member 182 biases bottom 134 of first side plate 162 away from bottom 134 of second side plate 172, movement of lower plate 110 toward upper plate 30 forces side plate bottoms 134 toward each other. Movement of side plate bottoms 134 toward each other allows tool 10 to contact the slat holder in such a manner to facilitate placement of the slat within the slat holder.

As illustrated in FIG. 6, rollers 46 and 54 extend beyond mounting brackets 44 and 52 (not shown in FIG. 6) to enable contact of rollers 46 and 54 with a surface, e.g., a slat, along which tool 10 travels. In addition, rollers 148 extend beyond side plates 130 and when tool 10 is positioned appropriately on a triangular slat holder and engaging assembly is engaged, lower rollers 148 contact and place pressure on the two triangular walls that extend away from the slat in contact with rollers 46 and 54. In an alternative embodiment, second side plate 172 is fixed with respect to lower plate 110 and does not pivot. In this embodiment, movement between side plate bottoms 134 occurs due to the pivoting movement of first side plate 162.

Figure 7:
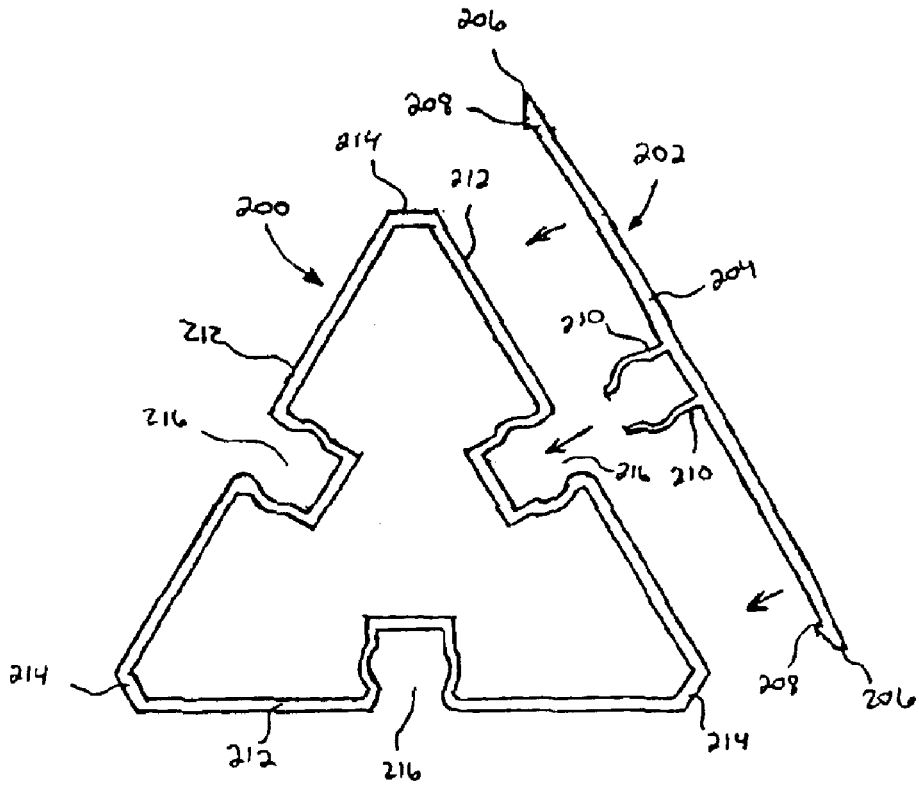
FIG. 7 is a schematic illustration of a triangular slat holder and a slat to be mounted to the slat holder.

FIG. 7 is a schematic illustration of a triangular slat holder 200 and a slat 202 to be mounted to slat holder 200 with a tool, such as tool 10 (shown in FIG. 1). Slat 202 includes a flat first portion 204 having a pair of ends 206. Each end 206 includes a projection 208. Slat 202 also includes a pair of contoured extension members 210 that extend substantially perpendicularly to first portion 204. Slat holder 200 includes three sides 212 and three blunt corners 214. Each side 210 includes a central slot 216 that extends along a length of slat holder 200 in the middle of a respective side 212. Each slot 216 is defined by a pair of contoured side walls 218 that are shaped similarly to extension members 210.

Slat 202 attaches to slat holder 200 by the interaction of extension members 210 with central slot 216 such that slat 202 is maintained adjacent slat holder 200. Each extension member 210 includes a projection 220 that interfits with a groove 222 in each side wall 218 to frictionally hold slat 202 in contact with slat holder 200. Slat end projections 208 fit within an empty space formed by blunt corners 214.

In one embodiment, slat installation tool 10 is utilized with triangular slat holders 200, which hold three slats 202. One slat 202 is held on each side 212 of triangular holder 200. Tool 10 is located at an end of the slat holder 200 such that a portion of slat holder 200 extends through tool 10. Once engaging assembly 14 is engaged, side plate assemblies 20 contact and grip, i.e., apply pressure to, the two sides 212 of slat holder 200 that extend away from side 212 on which slat 202 is being installed. As pressure is applied to the two sides 212, rollers 46, 54, and 62 contact slat 202 to be installed and force extension members 210 into central slot 216. As extension members 210 are forced into slat holder central slot 216, slat 202 is affixed to slat holder 200. After an end of slat 202 is properly positioned within slat holder 200, tool 10 is moved along slat holder 200 and the length of slat 202 is installed within the length of slat holder 200. When the entire length of slat 202 has been installed within slat holder 200, engaging assembly 14 is disengaged and side plate assemblies 20 lose contact with sides 212 of slat holder 200.

The above described invention provides an efficient and reliable tool and method for installing slats on a triangular slat holder. While the invention has been described in terms of various specific embodiments, those skilled in the art will recognize that the invention can be practiced with modification within the spirit and scope of the claims

What is claimed is:

1. Apparatus comprising:

an upper plate assembly comprising an upper plate which comprises a main portion, a first extension member and a second extension member, said extension members extending from said main portion at an angle;

a lower plate assembly comprising a lower plate, said lower plate assembly connected to said upper plate assembly;

a first side plate and a second side plate, said side plates connected to said lower plate assembly, each said side plate comprising a top and a bottom; and an engaging assembly attached to said upper plate assembly and said lower plate assembly, engagement of said engaging assembly causes said bottom of said first side plate to move toward said bottom of said second side plate and further causes said lower plate assembly to move towards said upper plate assembly.

2. The apparatus in accordance with claim 1 wherein said upper plate assembly comprises a top and a bottom, said upper plate assembly further comprises a front roller assembly and a back roller assembly, each roller assembly extending from said upper plate assembly bottom.

3. The apparatus in accordance with claim 1 wherein said first side plate is pivotably connected to said lower plate assembly, said first side plate comprising a roller assembly configured to contact and move along said first extension member.

4. The apparatus in accordance with claim 1 further comprising a biasing member connected to said first side plate, said biasing member for biasing said bottom of said first side plate away from said bottom of said second side plate.

5. The apparatus in accordance with claim 4 wherein said biasing member extends between said first side plate and said second side plate.

6. The apparatus in accordance with claim 1 wherein said lower plate assembly further comprises at least one guide pin and at least one biasing member, said upper plate assembly further comprising at least one guide pin receptacle for at least partially receiving a respective said guide pin, said biasing member biasing said lower plate assembly away from said upper plate assembly.

7. The apparatus in accordance with claim 1 wherein each said side plate comprises a lower roller assembly.

8. The apparatus in accordance with claim 1 further comprising a handle connected to said upper plate assembly.

9. The apparatus in accordance with claim 1 wherein said engaging assembly comprises a lever attached to a connecting member, said lever pivotably attached to said upper plate assembly.

10. A tool for installing slats on a triangular slat holder, said tool comprising:

an upper plate assembly;

a lower plate assembly connected to said upper plate assembly;

a pair of side plates connected to said lower plate assembly, wherein each said side plate includes at least one roller assembly that extends beyond said side plate; and an engaging assembly attached to said upper plate assembly and said lower plate assembly, engagement of said engaging assembly causes a bottom of said first side plate to move toward a bottom of said second side plate.

11. The tool in accordance with claim 10 further comprising at least one roller assembly that extends beyond said lower plate assembly when said engaging assembly is engaged.

12. The tool in accordance with claim 10 wherein said lower plate assembly is biased away from said upper plate assembly with at least one biasing member.

13. The tool in accordance with claim 10 wherein said side plates are connected to each other with at least one biasing member.

* * * * *